US005663028A

United States Patent [19]

Oftring et al.

[11] Patent Number: 5,663,028

[45] Date of Patent: Sep. 2, 1997

[54] ELECTROSTATIC TONERS CONTAINING AMINODIACETIC ACID DERIVATIVES

[75] Inventors: Alfred Oftring, Bad Durkheim; Juergen Schneider, Freinsheim; Rainer Dyllick-Brenzinger, Weinheim; Karin Heidrun Beck, Ludwigshafen, all of Germany

[73] Assignee: BASF Aktiengesellschaft, Ludwigshafen, Germany

[21] Appl. No.: 513,801

[22] PCT Filed: Aug. 9, 1994

[86] PCT No.: PCT/EP94/02635

§ 371 Date: Sep. 7, 1995

§ 102(e) Date: Sep. 7, 1995

[87] PCT Pub. No.: WO95/05624

PCT Pub. Date: Feb. 23, 1995

[30] Foreign Application Priority Data

Aug. 13, 1993 [DE] Germany ..... 43 27 179.0

[51] Int. Cl.[6] ..... G03G 9/097

[52] U.S. Cl. ..... 430/110; 430/137

[58] Field of Search ..... 430/110, 115, 430/137

[56] References Cited

U.S. PATENT DOCUMENTS

| | | | |
|---|---|---|---|
| 3,733,355 | 5/1973 | Harris et al. . | |
| 3,794,496 | 2/1974 | Manhardt . | |
| 3,826,747 | 7/1974 | Nagashima et al. | 430/110 |
| 4,082,748 | 4/1978 | Shier . | |
| 4,265,990 | 5/1981 | Stolka et al. . | |
| 4,673,631 | 6/1987 | Fukumoto et al. | 430/110 |

FOREIGN PATENT DOCUMENTS

| | | |
|---|---|---|
| 0 520 457 A2 | 12/1992 | European Pat. Off. . |
| 0132718 | 7/1994 | European Pat. Off. . |
| 2324378 | 12/1973 | Germany . |
| 3319759 | 5/1983 | Germany . |
| 3529780 | 8/1985 | Germany . |
| 61-250656 | 11/1986 | Japan . |
| 1202133 | 1/1969 | United Kingdom . |
| 2148287 | 10/1984 | United Kingdom . |

OTHER PUBLICATIONS

Zhurnal Obshchei Khimii, vol. 44, No. 3, pp. 574–577, Mar. 1974.

Helv. Chim. Acta 35 (1952), p. 1785.

Chemical Abstracts, vol. 88, 89303p, 1978.

Keihei Ueno, Ed., Chemistry of EDTA Complexane, pp. 99 to 105, 1977.

*Primary Examiner*—Christopher D. Rodee

*Attorney, Agent, or Firm*—Oblon, Spivak, McClelland, Maier & Neustadt, P.C.

[57] ABSTRACT

Electrostatic toners contain a polymeric binder and, as a charge stabilizer, a compound of the formula

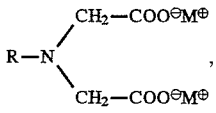

where $M^{\oplus}$ is one equivalent of a cation and

R is unsubstituted or substituted $C_1$–$C_{18}$-alkyl or unsubstituted or substituted phenyl.

20 Claims, No Drawings

ELECTROSTATIC TONERS CONTAINING AMINODIACETIC ACID DERIVATIVES

The present invention relates to novel electrostatic toners containing a polymeric binder and, as a charge stabilizer, a compound of the formula I

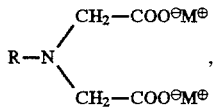

(I)

where $M^{\oplus}$ is one equivalent of a cation and

R is $C_1$–$C_{21}$-alkyl, which is unsubstituted or substituted by carboxyl or phenyl which may be substituted by $C_1$–$C_{10}$-alkyl, hydroxyl or a radical of the formula $L—N(CH_2—COO^{\ominus}M^{\oplus})_2$, where L is $C_1$–$C_4$-alkylene and $M^{\oplus}$ has the abovementioned meaning, and may be interrupted by from 1 to 4 ether oxygen atoms, from 1 to 4 imino or $C_1$–$C_4$-alkylimino groups or a radical of the formula $N—CH_2—COO^{\ominus}M^{\oplus}$, where $M^{\oplus}$ has the abovementioned meaning, or is phenyl which is unsubstituted or substituted by carboxyl, with the proviso that, when R is alkyl which has one or more hetero atoms, at least 5 carbon atoms bonded to one another are present in R, and the use of the above-mentioned compounds as charge stabilizers in electrostatic toners.

Latent electrostatic image recordings are developed by inductively recording the toner on the electrostatic image. The charge stabilizers stabilize the electrostatic charge of the toner. This makes the image stronger and gives it crisper contours.

The charge stabilizers used must meet a wide range of requirements:

ability to develop the latent electrostatic image into a visible image having high color strength capability of being readily distributed in the toner formulation in order to produce a faultless, uniform image having crisp contours insensitivity to moisture high heat stability.

EP-A-132 718 discloses electrostatic toners which contain N-acylated 3-aminopropionic acid derivatives as charge stabilizers.

Furthermore, U.S. Pat. No. 3,974,496 discloses photosensitive photographic materials which contain, as photosensitive material, silver salts of aminodiacetic acid and specific derivatives thereof.

However, it has been found that the prior art charge stabilizers frequently do not meet all requirements.

It is an object of the present invention to provide novel electrostatic toners which have charge stabilizers which possess advantageous performance characteristics.

We have found that this object is achieved by the electrostatic toners defined at the outset and containing aminodiacetic acid derivatives of the formula I as charge stabilizers.

All alkyl and alkylene groups occurring in the abovementioned formula I may be both straight-chain and branched.

If substituted phenyl groups occur in the above-mentioned formula I, they have, as a rule, from 1 to 3 substituents.

R is, for example, methyl, ethyl, propyl, isopropyl, butyl, isobutyl, sec-butyl, tert-butyl, pentyl, isopentyl, neopentyl, tert-pentyl, hexyl, 2-methylpentyl, heptyl, octyl, 2-ethylhexyl, isooctyl, nonyl, isononyl, decyl, isodecyl, undecyl, dodecyl, tridecyl, 3,5,5,7-tetramethylnonyl, isotridecyl (the above names isooctyl, isononyl, isodecyl and isotridecyl are trivial names and originate from the alcohols obtained by the oxo synthesis; cf. Ullmanns Enzyklopädie der technischen Chemie, 4th Edition, Volume 7, pages 215 to 217, and Volume 11, pages 435 and 436), tetradecyl, pentadecyl, hexadecyl, heptadecyl, octadecyl, nonadecyl, eicosyl, heneicosyl, 1-carboxyethyl, 1-carboxypropyl, 1-carboxybutyl, benzyl, 1- or 2-phenylethyl, 2-hydroxybenzyl, 3,5-dimethylbenzyl, 3,5-dibutylbenzyl, 3,5-di-tert-butylbenzyl, 2-hydroxy-3,5-di-tert-butylbenzyl, 2-methoxyethyl, 2-ethoxyethyl, 2-propoxyethyl, 2-isopropoxyethyl, 2-butoxyethyl, 2- or 3-methoxypropyl, 2- or 3-ethoxypropyl, 2- or 3-propoxypropyl, 2- or 3-butoxypropyl, 2- or 4-methoxybutyl, 2- or 4-ethoxybutyl, 2- or 4-propoxybutyl, 2- or 4-butoxybutyl, 3,6-dioxaheptyl, 3,6-dioxaoctyl, 4,8-dioxanonyl, 3,7-dioxaoctyl, 3,7-dioxanonyl, 4,7-dioxaoctyl, 4,7-dioxanonyl, 4,8-dioxadecyl, 3,6,8-trioxadecyl, 3,6,9-trioxaundecyl, 3,6,9,12-tetraoxatridecyl, 3,6,9,12-tetraoxatetradecyl, 2-mono- or dimethylaminoethyl, 2-mono- or diethylaminoethyl, 2- or 3-mono or dimethylaminopropyl, 2- or 3-mono- or diethylaminopropyl, 2- or 4-mono- or dimethylaminobutyl, 2- or 4-mono- or diethylaminobutyl, 3,6-diazaheptyl, 3,6,9-triazadecyl, 3,6,9,12-tetraazatetradecyl, 3,6-dimethyl-3,6-diazaheptyl, 3,6,9-trimethyl-3,6,9-triazadecyl, 3,6,9,12-tetramethyl-3,6,9,12-tetraazatetradecyl, phenyl, 2-, 3- or 4-carboxyphenyl or a radical of the formula $C_2H_4N(CH_2COO^{\ominus}M^{\oplus})C_5H_{11}$, $C_2H_4N(CH_2COO^{\ominus}M^{\oplus})C_6H_{13}$, $C_2H_4N(CH_2COO^{\ominus}M^{\oplus})C_8H_{17}$, $C_2H_4N(CH_2COO^{\ominus}M^{\oplus})—i—C_8H_{17}$, $C_2H_4N(CH_2COO^{\ominus}M^{\oplus})C_{13}H_{27}$, $C_2H_4N(CH_2COO^{\ominus}M^{\oplus})—i—C_{13}H_{27}$, $C_2H_4N(CH_2COO^{\ominus}M^{\oplus})C_{16}H_{33}$, $C_2H_4N(CH_2COO^{\ominus}M^{\oplus})C_{18}H_{37}$, $C_3H_6N(CH_2COO^{\ominus}M^{\oplus})C_5H_{11}$, $C_3H_6N(CH_2COO^{\ominus}M^{\oplus})C_6H_{13}$, $C_3H_6N(CH_2COO^{\ominus}M^{\oplus})C_8H_{17}$, $C_3H_6N(CH_2COO^{\ominus}M^{\oplus})—i—C_8H_{17}$, $C_3H_6N(CH_2COO^{\ominus}M^{\oplus})C_{13}H_{27}$, $C_3H_6N(CH_2COO^{\ominus}M^{\oplus})—i—C_{13}H_{27}$, $C_3H_6N(CH_2COO^{\ominus}M^{\oplus})C_{16}H_{33}$, $C_3H_6N(CH_2COO^{\ominus}M^{\oplus})C_{18}H_{37}$,

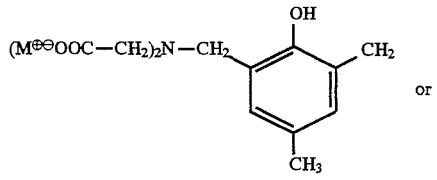

or

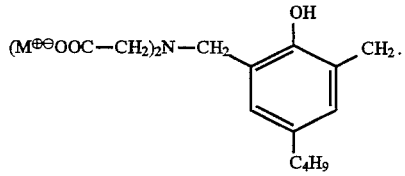

L is, for example, $CH_2$, $(CH_2)_2$, $(CH_2)_3$, $(CH_2)_4$, $CH(CH_3)CH_2$ or $CH(CH_3)CH(CH_3)$.

$M^{\oplus}$ is one equivalent of a cation. It is either a proton or is derived from ammonium or metal ions.

For the purposes of the present invention, ammonium ions are unsubstituted or substituted ammonium cations. Substituted ammonium cations are, for example, monoalkyl-, dialkyl-, trialkyl-, tetraalkyl- or benzyltrialkylammonium cations or cations which are derived from nitrogen-containing five-membered or six-membered saturated heterocycles, such as pyrrolidinium, piperidinium, morpholinium, piperazinium or N-alkylpiperazinium cations or their N-monoalkyl- or N,N-dialkyl-substituted products. For the purposes of the invention alkyl is generally straight-chain or branched $C_1$–$C_{20}$-alkyl which may be substituted by hydroxyl and/or interrupted by ether oxygen atoms.

Suitable metal ions are derived, for example, from metals of group IA, IIA, IIIA, IVA, VA, IB, IIB, IIIB, IVB, VB, VIB, VIIB or VIII of the Periodic Table of Elements.

Preferred electrostatic toners are those containing a compound of the formula I, where $M^{\oplus}$ is a proton or is derived from a metal of group IA, IIA or IIB of the Periodic Table of Elements, particular examples being protons or sodium, calcium or zinc ions.

Other preferred electrostatic toners are those containing a compound of the formula I, where R is $C_1$–$C_{18}$-alkyl, benzyl which is unsubstituted or substituted by $C_1$–$C_4$-alkyl or hydroxyl, or phenyl which is unsubstituted or substituted by carboxyl.

Particularly preferred electrostatic toners are those containing a compound of the formula I, where R is $C_4$–$C_{16}$-alkyl, benzyl which is substituted by $C_1$–$C_4$-alkyl or hydroxyl, or phenyl which is substituted by carboxyl.

Very particularly preferred electrostatic toners are those containing a compound of the formula I, where R is $C_6$–$C_{12}$-alkyl, 2-hydroxy-3,5-di-tert-butylbenzyl or 2-carboxyphenyl.

The aminodiacetic acid derivatives of the formula I are as a rule compounds which are known or which can be obtained by methods known per se.

For example, aminodiacetic esters of the formula II

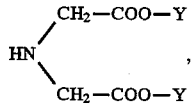

(II)

where Y is $C_1$–$C_4$-alkyl, can be alkylated with a compound of the formula III $$R—X \qquad (III)$$

where R has the abovementioned meanings and X is chlorine, bromine or iodine, and the resulting alkylated ester can be hydrolyzed (J. General Chem. USSR, 44 (1974), 574–577).

It is also possible to prepare the compounds of the formula I, for example, by means of a Strecker synthesis, as described, for example, in U.S. Pat. No. 3,733,355, by hydrolysis of the corresponding nitriles (GB-A-1 202 133), by dehydrogenation of the corresponding amino alcohols (GB-A-2 148 287) or from cyclic diglycolimides (U.S. Pat. No. 4,082,748).

Those aminodiacetic acid derivatives which contain an orthophenolate structure in the general formula may be prepared from commercially available phenols or phenol derivatives by a one-stage Mannich reaction. In particular, they can be synthesized by the method stated in Helv. Chim. Acta 35 (1952), 1785, or Keihei Ueno, Ed., Chemistry of EDTA Complexane, pages 99 to 105, 1977. This synthesis is illustrated in Example H1.

The synthesis of the alkyl- and arylaminodiacetic acids can also be carried out by the known reaction of the commercial amine starting component with halocarboxylic acids. For example, o-carboxyphenylaminodiacetic acid can be synthesized by reacting anthranilic acid with chloroacetic acid in an aqueous medium (Chem. Abstracts, Volume 88, 89303p, 1978, or EP-A-520 547).

The free acid is isolated in a manner known per se, for example by acidifying the solution of a readily soluble salt to the isoelectric point of the amino acid.

The metal salts having divalent or polyvalent cations, which are generally moderately to poorly soluble in water, for example the zinc or calcium salts, are synthesized by reacting the free acid or soluble salts of the amino acids with salts of the desired cation. The end products generally crystallize out of the solution and can thus be isolated and dried. In a further possible method, the free acids are reacted with the metal oxides or hydroxides of the desired cations. The Examples give further details of the synthesis of these salts.

The amount of the compounds of the formula I in the electrostatic toners is as a rule from 0.01 to 10% by weight, based on the weight of the toner.

The polymeric binders present in the novel electrostatic toners are known per se. They are as a rule thermoplastic and have a softening point of from 40° to 200° C., preferably from 50° to 130° C., in particular from 65° to 115° C. Examples of polymeric binders are polystyrene, copolymers of styrene with an acrylate or methacrylate, copolymers of styrene with butadiene and/or acrylonitrile, polyacrylates, polymethacrylates, copolymers of an acrylate or methacrylate with vinyl chloride or vinyl acetate, polyvinyl chloride, copolymers of vinyl chloride with vinylidene chloride, copolymers of vinyl chloride with vinyl acetate, polyester resins, epoxy resins, polyamides or polyurethanes.

In addition to the abovementioned compounds of the formula I and the polymeric binders, the novel toners may contain known amounts of colorants, magnetically attractable material, waxes and fluxes.

The colorants may be organic dyes or pigments, such as nigrosine, aniline blue, 2,9-dimethylquinacridone, C.I. Disperse Red 15 (C.I. 6010), C.I. Solvent Red 19 (C.I. 26,050), C.I. Pigment Blue 15 (C.I. 74,160), C.I. Pigment Blue 22 (C.I. 69,81) or C.I. Solvent Yellow 16 (C.I. 12,700), or inorganic pigments, such as carbon black, red lead, yellow lead oxide or chrome yellow. In general, the amount of the colorant present in the toner does not exceed 15% by weight, based on the weight of the toner.

The magnetically attractable material may be, for example, iron, nickel, chromium oxide, iron oxide or a ferrite of the formula $MeFe_2O_4$, where Me is a divalent metal, eg. iron, cobalt, zinc, nickel or manganese.

The novel toners are prepared by conventional processes, for example by mixing of the components in a kneader and subsequent powdering, or by melting the polymeric binder or a mixture of polymeric binders, then finely distributing one or more compounds of the formula I and the other additives, where used, in the molten resin using the mixing and kneading apparatuses known for this purpose, then cooling the melt to a solid material and finally milling the solid material to give particles of the desired particle size (as a rule from 0.1 to 50 μm). It is also possible to dissolve the polymeric binder and the charge stabilizer in a common solvent and to add the other additives to the solution. The solution can thus be used as a liquid toner.

However, the liquid may also be spray-dried in a manner known per se, the solvents evaporated off or the liquid freeze-dried and the solid residue milled to give particles of the desired particle size.

It is also possible not to dissolve the compounds of the formula I which are used as charge stabilizers but to disperse them finely in the solution of the polymeric binder. The toner formulation thus obtained can then be used in a xerographic image recording system, for example according to U.S. Pat. No. 4,265,990.

The abovementioned compounds of the formula I are advantageous charge stabilizers. As a rule, they have the performance characteristics required at the outset and, when added to a toner preparation, impart to the latter an advantageous electrostatic charge profile, ie. the toners can be charged rapidly and to a great extent. The charge stabilizers to be used according to the invention furthermore ensure that the charge is kept constant at a high level.

The Examples which follow illustrate the invention.

A) Preparation of the Aminodiacetic Acid Derivatives

EXAMPLE H1

Disodium 2,4-di-tert-butylphenyl-6-(aminomethylene-N,N-diacetate)

133 g of aminodiacetic acid, 200 g of water, 500 g of methanol, 206 g of 2,5-di-tert-butylphenol and 88 g of sodium hydroxide were initially taken in a flask. 100 g of 30% strength by weight aqueous formaldehyde solution were added to this solution in the course of 2 hours. Stirring was carried out for 4 hours at room temperature and refluxing for 5 hours. Thereafter, the mixture was cooled to room temperature, a further 50 g of 30% strength by weight aqueous formaldehyde solution were added, refluxing was carried out for 4 hours and the mixture was then cooled to room temperature. 235 g (60%) of a colorless powder were obtained in this manner.

EXAMPLE H2

Zinc 2,4-di-tert-butylphenyl-6-(aminomethylene-N,N-diacetate)

11 g of zinc chloride were added to the solution of 31.6 g of the powder obtained in Example H1 in 250 ml of water at 70° C., the mixture was refluxed for 15 minutes and the residue obtained after cooling was filtered off. It was washed chloride-free with water and dried. 30 g (90%) of the zinc salt of H1 were obtained in this manner. The finely powdered product can be directly used.

EXAMPLE H3

Zinc o-carboxyphenylaminodiacetate 24.5 g of zinc chloride were added to a solution of 50.6 g of o-carboxyphenylaminodiacetic acid and 16 g of sodium hydroxide in 300 g of water at 75° C., and a pH of 3 was maintained by adding sodium hydroxide solution. The mixture was heated at 95° C. for 15 minutes and cooled to 10° C. and the precipitated solid was separated off. 154 g (60% of theory) of a colorless solid were obtained in this manner. The zinc salt thus isolated can be directly used.

EXAMPLE H4

Octylaminodiacetic acid 63 g of 30% strength by weight aqueous formaldehyde solution, 17.8 g of hydrogen cyanide and 7.3 g of sulfuric acid were added to a solution of 38.8 g of octylamine in 500 g of water. The reaction was ended after 3 hours at room temperature. Without isolating the product, the complete batch was added to 67.2 g of 50% strength by weight sodium hydroxide solution and hydrolysis was carried out at 100° C. for 7 hours. The reaction mixture was brought to a pH of 2 with sulfuric acid and the precipitated product was filtered off under suction and washed sulfate-free with water. After drying, 59.6 g (81% of theory) of octylaminodiacetic acid were obtained.

EXAMPLE H5

Zinc octylaminodiacetate 6.9 g of zinc chloride were added to 12.3 g of the solid obtained in Example H5 and 8 g of 50% strength by weight sodium hydroxide solution in 60 ml of water at 75° C. After the addition, the mixture was heated at 100° C. for 10 minutes and the product obtained after cooling was filtered off under suction and washed chloride-free with water. 15 g (97% of theory) of a colorless solid was obtained in this manner and can be directly used.

EXAMPLE H6

Nonylglycinediacetic acid 14 g of 96% strength by weight sulfuric acid, 30.2 g of 98.4% strength by weight hydrogen cyanide and 172 g of decanal were added dropwise in succession to a suspension of 95 g of iminodiacetonitrile in 500 g of water and stirring was carried out for 17 hours at 60° C. and for 2 hours at 80° C. until no further change was detectable in the hydrocyanic acid content by titration. After cooling to 10° C., the aqueous phase was separated off and the remaining oil was extracted twice by shaking with 500 ml of water. 205 g (79% of theory) of nonylglycinenitrile-N,N-diacetonitrile were obtained from the organic phase.

205 g of this oil were then introduced into 600 g of 18% strength by weight sodium hydroxide solution together with 600 ml of butanol at 40° C. and were stirred for 30 hours at 95° C. Thereafter, the volatile components were distilled off, the residue was taken up in water and brought to a pH of 1 with hydrochloric acid and the resulting precipitate was isolated by filtration. 209 g (68% of theory) of nonylglycinediacetic were thus obtained.

B) Use

The Use Examples were carried out with colorant-free toner models consisting of resin and the novel charge stabilizers.

I. Preparation of the toners

EXAMPLE A1

0.2 g of the compound from Example H4 was introduced into a solution of 10 g of an uncrosslinked styrene/butyl acrylate resin in 100 ml of p-xylene at room temperature, and the mixture was then freeze-dried and milled. Toner particles having a mean particle size of 50 μm were obtained by classification.

EXAMPLE A2

10 g of an uncrosslinked styrene/butyl acrylate resin and 0.2 g of the compound from Example H4 were thoroughly mixed in a mixer, kneaded at 120° C., extruded and milled. Toner particles having a mean particle size of 50 μm were obtained by classification.

EXAMPLE A3

0.2 g of the compound from Example H2 was introduced into a solution of 10 g of linear polyester resin in 100 ml of p-xylene at room temperature and the mixture was then freeze-dried and milled. Toner particles having a mean particle size of 50 μm were obtained by classification.

EXAMPLE A4

10 g of a linear, uncrosslinked polyester resin and 0.2 g of the compound from Example H2 were thoroughly mixed in a mixer, kneaded at 120° C., extruded and milled. Toner particles having a mean particle size of 50 μm were obtained by classification.

EXAMPLE A5

0.2 g of the compound from Example H3 was introduced into a solution of 10 g of linear polyester resin in 100 ml of p-xylene at room temperature and the mixture was then freeze-dried and milled. Toner particles having a mean particle size of 50 μm were obtained by classification.

EXAMPLE A6

0.2 g of the compound from Example H4 was introduced into a solution of 10 g of linear polyester resin in 100 ml of p-xylene at room temperature and the mixture was then freeze-dried and milled. Toner particles having a mean particle size of 50 μm were obtained by classification.

EXAMPLE A7

0.2 g of the compound from example H5 was introduced into a solution of 10 g of linear polyester resin in 100 ml of p-xylene at room temperature and the mixture was then freeze-dried and milled. Toner particles having a mean particle size of 50 μm were obtained by classification.

EXAMPLE A8

0.2 g of the compound from example H6 was introduced into a solution of 10 g of linear polyester resin in 100 ml of p-xylene at room temperature and the mixture was then freeze-dried and milled. Toner particles having a mean particle size of 50 μm were obtained by classification.

II. Preparation of the Developers and Testing

For the preparation of a developer, 99% by weight of a steel carrier which had a mean particle size of 100 μm were accurately weighed in with 1% by weight of the toner and activated on a roller stand for a period determined below. Thereafter, the electrostatic charge of the developer was determined. Using a commercial q/m meter (Epping GmbH, Neufahrn), about 5 g of the activated developer were introduced into a hard-blow-off cell which was connected electrically to an electrometer. The mesh size of the sieves used in the measuring cell was 63 μm for the Examples.

This ensured that the toner was blown off as completely as possible but the carrier remained in the measuring cell. By means of a powerful air stream (about 4,000 $cm^3$/min) and simultaneous suction, the toner was virtually completely removed from the carrier particles, the latter remaining in the measuring cell. The charge on the carrier was recorded in the electrometer. It corresponded to the magnitude of the charge on the toner particles, but with the opposite sign. The magnitude of q with the opposite sign was therefore used to calculate the q/m value. By reweighing the measuring cell, the mass of blown-off toner was determined and the electrostatic charge q/m was calculated from this.

The charge determined for the toners is summarized in the Table below.

TABLE

| Example No. | Compound from Example | Formulation of the toner* | Charge after activation for 10 min | 30 min | 60 min | 120 min |
|---|---|---|---|---|---|---|
| | | | [μC/g] | | | |
| A1 | H4 | G | −13.1 | −19.2 | −21.8 | −22.4 |
| A2 | H4 | K | −14.5 | −15.3 | −15.1 | −16.2 |
| A3 | H2 | G | −12.7 | −13.6 | −13.8 | −14.1 |

TABLE-continued

| Example No. | Compound from Example | Formulation of the toner* | Charge after activation for 10 min | 30 min | 60 min | 120 min |
|---|---|---|---|---|---|---|
| | | | [μC/g] | | | |
| A4 | H2 | K | −11.5 | −12.0 | −11.8 | −11.7 |
| A5 | H3 | G | −13.1 | −12.4 | −11.3 | −10.2 |
| A6 | H4 | G | | −8.8 | | |
| A7 | H5 | G | −9.5 | −13.7 | −16.2 | −18.7 |
| A8 | H6 | G | −3.5 | −3.9 | −3.4 | −3.4 |

*The toner is formulated either by freeze-drying according to Example A1 (denoted by G in the Table) or by kneading at above the softening point of the resin according to Example A2 (denoted by K in the Table).

We claim:

1. An electrostatic toner, comprising a polymeric binder and, as a charge stabilizer, a compound of the formula (I):

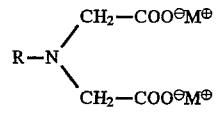

(I)

wherein:

$M^{\oplus}$ is one equivalent of a cation and R is $C_1$–$C_{21}$ alkyl, which is unsubstituted or substituted by:

(i) carboxyl, or (ii) phenyl, which is unsubstituted or substituted by: $C_1$–$C_{10}$ alkyl, hydroxyl or a radical of the formula $L—N(CH_2—COO^{\ominus}M^{\oplus})_2$, where L is $C_1$–$C_4$-alkylene and $M^{\oplus}$ has the above-mentioned meaning, and R is uninterrupted or interrupted by from 1 to 4 ether oxygen atoms, from 1 to 4 imino or $C_1$–$C_4$-alkyl imino groups or a radial of the formula $N—CH_2—COO^{\ominus}M^{\oplus}$, where $M^{\oplus}$ has the above mentioned meaning, or R is phenyl, which is unsubstituted or substituted by carboxyl, with the proviso that, when R is alkyl, which has one or more heteroatoms, at least 5 carbon atoms in the interrupted alkyl chain are present in R.

2. The electrostatic toner of claim 1, where $M^{\oplus}$ in the compound of the formula (I), is hydrogen or is an ammonium-based or metal ion.

3. The electrostatic toner of claim 2, wherein said ammonium-based ion is selected from the group consisting of monoalkyl-, dialkyl-, trialkyl-, tetraalkyl- and benzyltrialkylammonium cations; pyrrolidinium, piperidinium, morpholinium, piperazinium, and N-monoalkyl and N,N-dialkyl-substituted pyrrolidinium, piperidinium, morpholinium and piperazinium.

4. The electrostatic toner of claim 2, wherein said metal ion is selected from the group consisting of metals of group IA, IIA, IIIA, IVA, VA, IB, IIB, IIIB, IVB, VB, VIB, VIIB and VIII of the Periodic Table.

5. The electrostatic toner of claim 4, wherein said metal ion is selected from the group consisting of metals of groups IA, IIA or IIB.

6. The electrostatic toner of claim 5, wherein said metal ion is a sodium, calcium or a zinc ion.

7. The electrostatic toner of claim 1, where R in the formula (I), is $C_1$–$C_{18}$-alkyl, benzyl which is unsubstituted or substituted by $C_1$–$C_4$-alkyl or hydroxyl, or phenyl which is unsubstituted or substituted by carboxyl.

8. The electrostatic toner of claim 1, wherein R of the formula (I), is $C_4$–$C_{16}$-alkyl, benzyl which is substituted by $C_1$–$C_4$-alkyl or hydroxyl; or phenyl which is substituted by carboxyl.

9. The electrostatic toner of claim 1, containing from 0.01 to 10% by weight, based on the weight of the toner, of the compound of the formula (I).

10. The electrostatic toner of claim 1, wherein in the formula (I), R is $C_6$–$C_{12}$-alkyl, 2-hydroxy-3,5-di-tert-butylbenzyl or 2-carboxyphenyl.

11. A method of forming a charge-stable electrostatic toner, which comprises mixing in a kneader a polymeric binder and an amount of the compound of the formula (I):

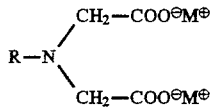

(I)

in an amount sufficient to stabilize said charge of said electrostatic toner, followed by powdering, and wherein $M^{\oplus}$ is one equivalent of a cation and R is $C_1$–$C_{21}$-alkyl, which is unsubstituted or substituted by:

(i) carboxyl, or (ii) phenyl, which is unsubstituted or substituted by: $C_1$–$C_{10}$ alkyl, hydroxyl or a radical of the formula $L—N(CH_2—COO^{\ominus}M^{\oplus})_2$, where L is $C_1$–$C_4$-alkylene and $M^{\oplus}$ has the above-mentioned meaning, and R is uninterrupted or interrupted by from 1 to 4 ether oxygen atoms, from 1 to 4 imino or $C_1$–$C_4$-alkyl imino groups or a radical of the formula $N—CH_2—COO^{\ominus}M^{\oplus}$, where $M^{\oplus}$ has the above-mentioned meaning, or R is phenyl, which is unsubstituted or substituted by carboxyl, with the proviso that, when R is alkyl, which has one or more heteroatoms, at least 5 carbon atoms in the interrupted alkyl chain are present in R.

12. The method of claim 11, wherein about 0.01 to 10% by weight of said compound of the formula (I) is mixed with said binder based upon the weight of the toner.

13. The method of claim 11, where $M^{\oplus}$ in the compound of the formula (I), is hydrogen or is an ammonium-based or metal ion.

14. The method of claim 13, wherein said ammonium-based ion is selected from the group consisting of monoalkyl-, dialkyl-, trialkyl-, tetraalkyl- and benzyltrialkylammonium cations; pyrrolidinium, piperidinium, morpholinium, piperazinium, and N-monoalkyl and N,N-dialkyl-substituted pyrrolidinium, piperidinium, morpholinium and piperazinium.

15. The method of claim 13, wherein said metal ion is selected from the group consisting of metals of group IA, IIA, IIIA, IVA, VA, IB, IIB, IIIB, IVB, VB, VIB, VIIB and VIII of the Periodic Table.

16. The method of claim 13, wherein said metal ion is selected from the group consisting of metals of groups IA, IIA or IIB.

17. The method of claim 13, wherein said metal ion is a sodium, calcium or a zinc ion.

18. The method of claim 11, where R in the formula (I), is $C_1$–$C_{18}$-alkyl, benzyl which is unsubstituted or substituted by $C_1$–$C_4$-alkyl or hydroxyl, or phenyl which is unsubstituted or substituted by carboxyl.

19. The method of claim 11, wherein R of the formula (I), is $C_4$–$C_{16}$-alkyl, benzyl which is substituted by $C_1$–$C_4$-alkyl or hydroxyl; or phenyl which is substituted by carboxyl.

20. The method of claim 11, wherein in the formula (I), R is $C_6$–$C_{12}$-alkyl, 2-hydroxy-3,5-di-tert-butylbenzyl or 2-carboxyphenyl.

* * * * *